United States Patent [19]

Deines

[11] 4,077,569

[45] Mar. 7, 1978

[54] FLUID-FLOW PULSATOR

[75] Inventor: Siegmund Deines, Ft. Collins, Colo.

[73] Assignee: Teledyne Industries, Inc., Ft. Collins, Colo.

[21] Appl. No.: 729,010

[22] Filed: Oct. 4, 1976

[51] Int. Cl.[2] ..... B05B 1/08

[52] U.S. Cl. ..... 239/101; 91/280; 137/509; 239/533.15; 239/570

[58] Field of Search ..... 239/101, 102, 533.1, 239/533.15, 570; 137/509, 624.14, 516.29; 91/280, 460, 468; 251/332

[56] References Cited

U.S. PATENT DOCUMENTS

| | | | |
|---|---|---|---|
| 2,610,021 | 9/1952 | Smith | 251/332 |
| 2,825,602 | 3/1958 | Rabbitt | 239/533.15 X |
| 3,054,422 | 9/1962 | Napolitano | 137/509 |
| 3,202,178 | 8/1965 | Wolfe | 137/516.29 |
| 3,345,915 | 10/1967 | Dotto | 137/624.14 X |
| 3,430,652 | 3/1969 | Struck | 137/509 X |
| 3,902,664 | 9/1975 | Deines | 239/102 |

FOREIGN PATENT DOCUMENTS

| | | | |
|---|---|---|---|
| 306,819 | 8/1971 | U.S.S.R. | 239/101 |

*Primary Examiner*—Evon C. Blunk
*Assistant Examiner*—Andres Kashnikow
*Attorney, Agent, or Firm*—Hugh H. Drake

[57] ABSTRACT

In a fluid-flow pulsator, a housing has a chamber with an inlet and an outlet. Within the housing is a piston assembly having first and second pistons with the first having a working area less than that of the second. A valve associated with the assembly closes the outlet on movement of the assembly. The assembly is resiliently urged in a direction effecting closure of the outlet with the first and second pistons effectively being disposed in the chamber on opposite sides of the inlet. The introduced fluid pressure, the urging strength and the piston areas are correlated so as to produce pulses of fluid from the outlet in response to a supply of fluid to the inlet.

22 Claims, 16 Drawing Figures

FLUID-FLOW PULSATOR

The present invention relates to a fluid-flow pulsator. More particularly, it pertains to a device responsive to the inlet of fluid under pressure for delivering that fluid from an outlet in the form of pulses.

Apparatus for delivering pulses of a flowing fluid, such as water, have been many and varied. One approach, recently quite successful in the field of showerheads, has been to chop a water stream into a series of pulses by means of a rotating impeller driven by the flowing water. A somewhat different approach has been to receive inlet fluid flow into an expansible chamber which responds by opening an outlet valve upon a predetermined amount of receipt of the input flow. Apparatus of this kind is described and claimed in U.S. Pat. No. 3,902,664. The particular embodiments of that patent employ an elongated resilient sleeve which both constitutes the wall of the expansible chamber and also serves as the correlated valve operator. In that apparatus, reliance for operation is placed upon the characteristics of the resilient sleeve, an element which is dynamic in character and thereby subject to variation of its characteristics in use.

It is, accordingly, a general object of the present invention to provide a new and improved pulsator that avoids operational difficulties that may occur in devices of a kind hereinbefore described.

Another object of the present invention is to provide a new and improved pulsator in which the valve-operated elements are fixedly formed of solid material.

A further object of the present invention is to provide a new and improved pulsator which lends itself to implementation in a variety of different embodiments.

A fluid-flow pulsator constructed in accordance with the present invention includes a housing which defines an internal chamber and has means that define an inlet and an outlet each of which communicate with the chamber. The inlet admits the fluid under a predetermined static pressure and the outlet releases that fluid from the chamber. A piston assembly is mounted for movement within the housing, the assembly including a first piston spaced from a second piston effectively toward the outlet opening and with the first piston having an area, exposed within the chamber to fluid pressure introduced therein through the inlet, less than a corresponding area of the second piston. Means associated with the assembly valvingly closes the outlet when the assembly is moved theretoward. The assembly is resiliently urged in a direction effecting closure of the outlet with the first and second pistons effectively being disposed in the chamber on opposite sides of the inlet. The pressure, the strength of the urging and the areas of the pistons all are correlated to produce and are essentially determinative of the production of pulses of fluid from the outlet in response to a supply of fluid to the inlet.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
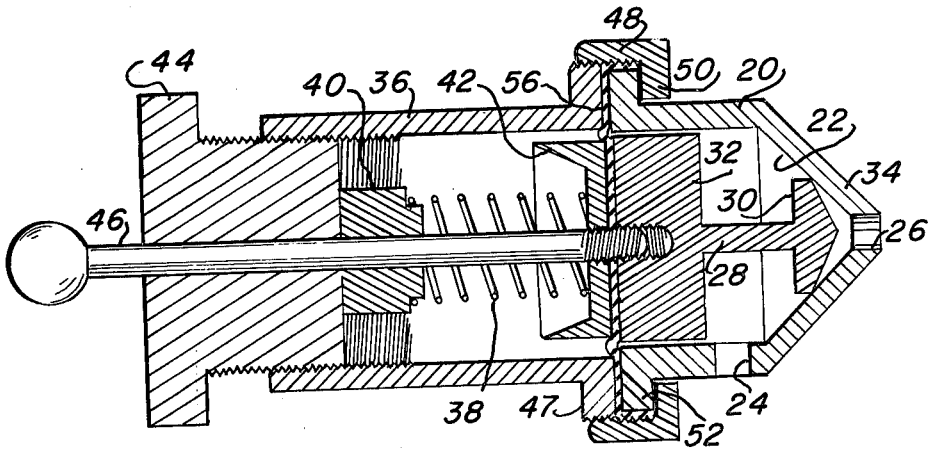
FIG. 1 is a centrally-taken cross-sectional view through a pulsator.

The pulsator of FIG. 1 includes a housing 20 which defines an internal chamber 22 and has an inlet 24 and an outlet 26 each of which communicates with chamber 22. Inlet 24 admits a fluid such as water under a predetermined static pressure and outlet 26 serves to release that fluid from chamber 22. A piston assembly 28 is mounted for movement within housing 20. Assembly 28 includes a first piston 30 spaced from a second piston 32 toward outlet 26; piston 30 has a working area, exposed within chamber 22 to the pressure of fluid introduced therein through inlet 24, that is less than the corresponding area of piston 32.

Housing 20 includes a nose portion 34 of reduced size compared with the remainder of housing 20. Nose portion 34 cooperates with one face of piston 30 for valvingly closing outlet 26 when the associated piston assembly 28 is moved toward outlet 26.

Housing 20 also includes an extension 36 which defines an interior within which is located a spring 38 compressed between a block 40 and a retainer 42. Block 40 is secured on the internal face of a plug 44 threadably received into the interior of extension 36. Projecting axially through plug 44 and block 40 is a stabilizing guide 46 the internal end of which is threaded through retainer 42 and into piston 32. Threadably received upon the external periphery of a flange 47 on extension 36 is a collar 48 which has an in-turned rim 50 disposed to urge a flange 52 on housing 20 toward flange 47. Secured around its peripheral margin between flanges 47 and 52 is a diaphragm 56 of resilient material. Moreover, retainer 42 and piston 32 are clamped on opposite sides of the central portion of diaphram 56 by means of guide 46. As so constructed, spring 38 resiliently urges piston assembly 28 in a direction effecting closure of outlet 26 by the forward face of piston 30.

It will be observed that pistons 30 and 32 are disposed within chamber 22 on opposite sides of inlet 24. The arrangement of the different components of FIG. 1 is such that the fluid pressure, the strength of spring 38 and the working areas of pistons 30 and 32 exposed to fluid introduced through inlet 24 are so correlated as to produce pulses of fluid flowing from outlet 26 in response to the supply of the fluid through inlet 24. Basic design considerations are toward the end that the flowing pressure of water passing through the system is as close as possible to the unflowing static pressure present at inlet 24 in the absense of flow. Operation relies upon pressure differences resulting during operation as between the opening and closing of the valving mechanism of which piston 30 forms a part. A key parameter of design is that the pressure necessary to open the outlet valve is greater than that required for its closure.

Figure 4:
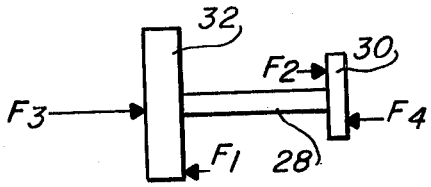
FIG. 4 is a force diagram relative to operation upon one of the components shown in FIGS. 2 and 3.
Figure 2:
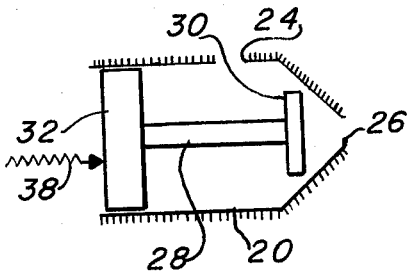
FIG. 2 is a schematic diagram of such a pulsator with the essential components in one position of operation.
Figure 3:
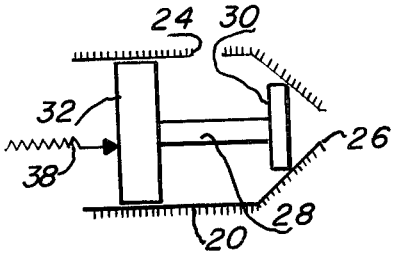
FIG. 3 is a similar schematic diagram with the essential components in a different position of operation.
Figure 5:
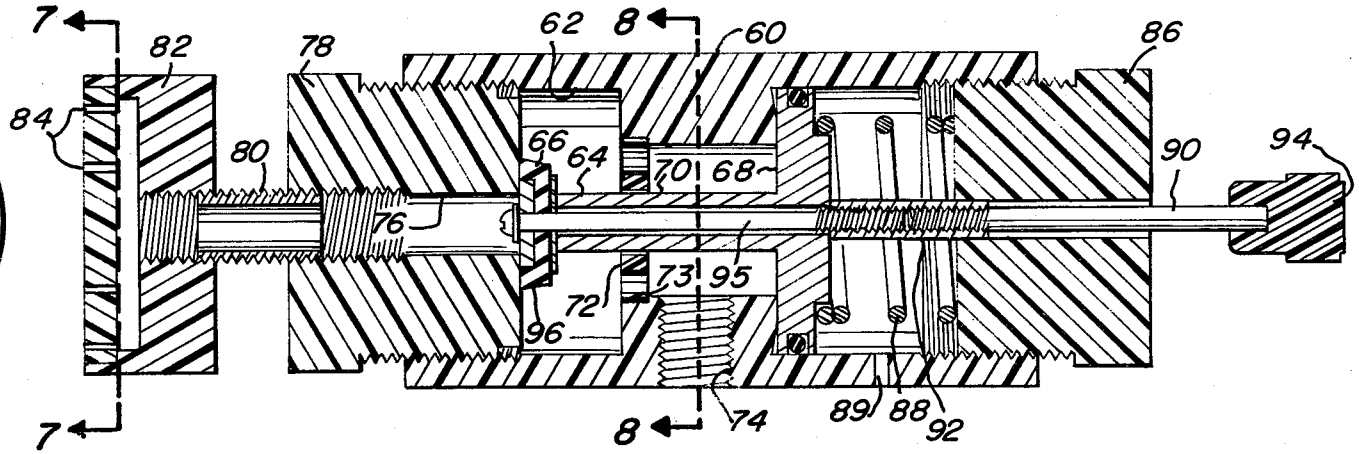
FIG. 5 is a centrally-taken cross-sectional view of another embodiment of a pulsator.
Figure 6:
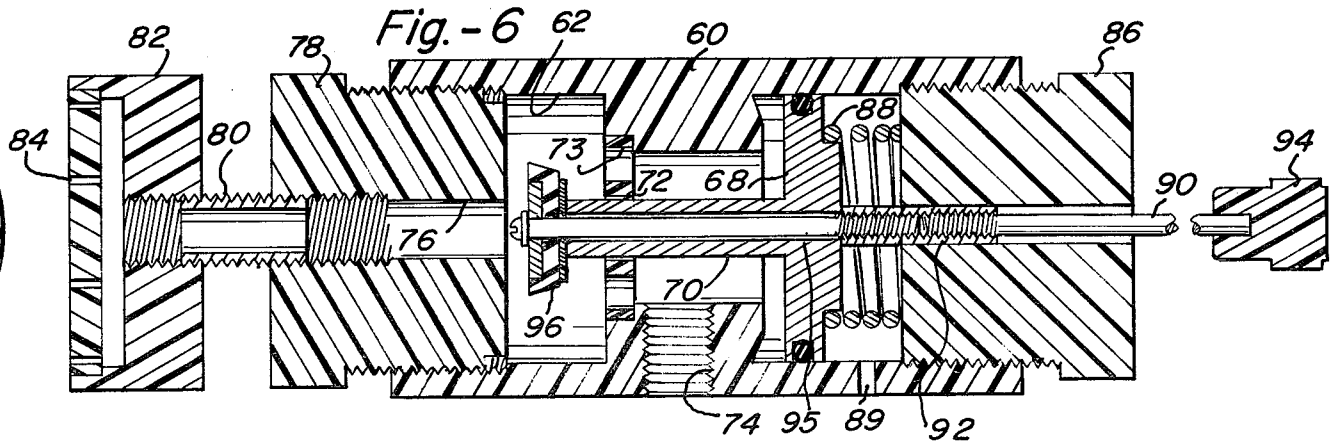
FIG. 6 is a view like that of FIG. 5 but with certain principle components disposed in a different position.
Figure 7:
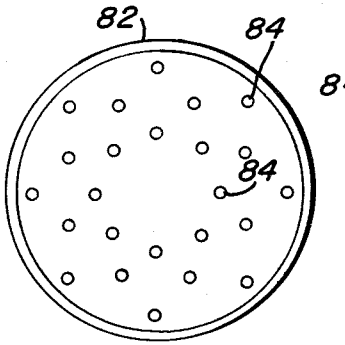
FIG. 7 is a cross-sectional view taken along the line 7—7 in FIG. 5.
Figure 8:
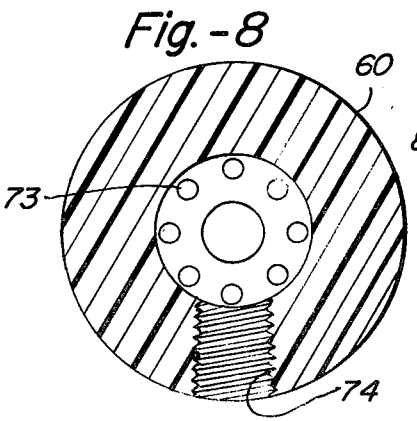
FIG. 8 is a cross-sectional view taken along the line 8—8 in FIG. 5.
Figure 9:
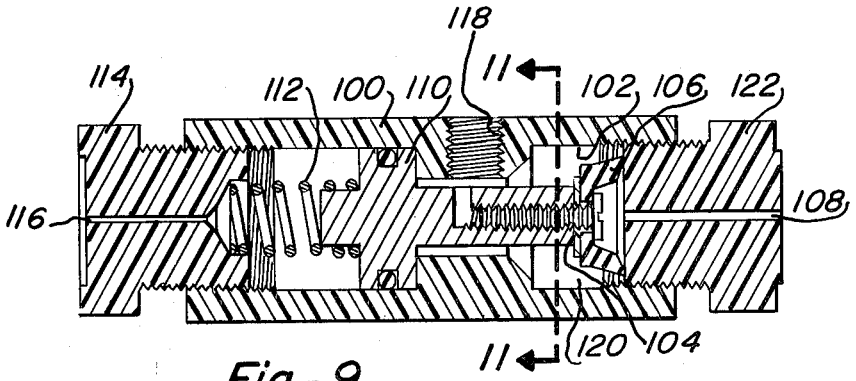
FIG. 9 is a centrally-taken cross-sectional view of a modified form of pulsator.
Figure 10:
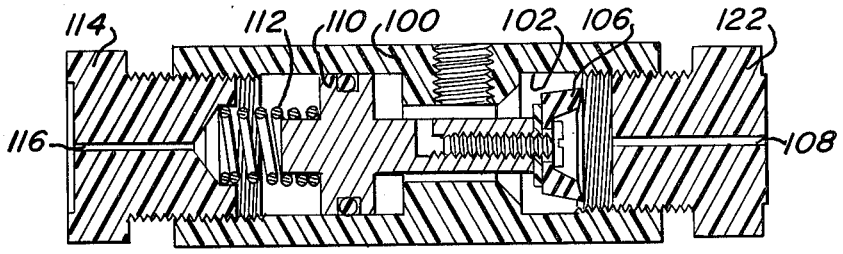
FIG. 10 is a view like that of FIG. 9 but with certain of the principal components disposed in a different position.
Figure 11:
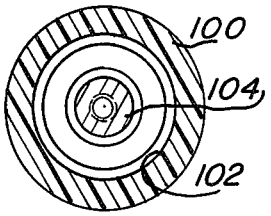
FIG. 11 is a cross-sectional view taken along the line 11—11 in FIG. 9.

The principles of operation are best understood by the reference to FIGS. 2–4. FIG. 2 represents the relationship of the elements in the condition in which outlet 26 is open so that fluid is permitted to flow outwardly therefrom. FIG. 3 represents the opposite condition in which the valving action associated with piston 30 serves to close outlet 26. FIG. 4 is a diagram of forces acting upon piston assembly 28 during operation. In that diagram, a force $F_1$ represents the pressure of the fluid introduced through inlet 24 upon the face of piston 32. $F_2$ is the opposing force of the same fluid upon the face of piston 30. $F_3$ represents the force exerted by spring 38 as possibly modified by any force along the same axis and imposed by diaphram 56; in normal operation, at least for purposes of explanation, only the force urged by spring 38 need be considered. $F_4$ represents the force operating upon piston assembly 28 and seeking to open the passage for flow of fluid through outlet 26. Although it will be recognized that a simple coil spring tends to increase in force against compression when more tightly compressed, it is satisfactory for present analysis to consider force $F_3$ to be a constant. Thus, it is assumed for present purposes that only forces $F_1$, $F_2$ and $F_4$ change as between the open and closing conditions of the outlet valving mechanism.

In the closed-valve condition as illustrated in FIG. 3, $F_4$ is the force of the valve face of piston 30 resting against the nose of housing 20. On the other hand, when the valve mechanism is open as illustrated in FIG. 2, $F_4$ equals the pressure of the water multipled by the effective cross-sectional area of the valve. Forces $F_1$ and $F_2$ vary in correspondence with variation in the internal water pressure. In all cases, the force exerted by the water pressure is equal to that pressure multiplied by the cross-sectional area acted against. Thus, $F_1$ equals the water pressure times the effective area of piston 32. $F_2$ equals that pressure multiplied by the effective area of piston 30. Recalling that $F_3$ is the effective force of spring 38, it can be seen that $F_4$ equals the sum of $F_2$ and $F_3$ minus $F_1$.

Recapitulating, it can be seen that the force which causes the valve mechanism to open has to be $F_1$. To achieve such opening, $F_1$ must overcome the spring force $F_3$ in addition to the force $F_2$ of the water pressure upon piston 30. Thereafter, the valve mechanism cannot close until a lower pressure condition is reached. When the valve mechanism opens, $F_4$ changes from a static to a dynamic force, it is then no longer the force of the valving piston resting against the housing but, instead, is related to an internal water pressure, that is constantly changing, multiplied by the cross-sectional are of piston 30. Once the valve mechanism is opened, $F_1$ is added to $F_4$, and that sum of forces is applied against the spring force $F_3$ and the force $F_2$ acting against piston 30. Since forces $F_4$ and $F_1$ are at this point added together, the valve does not close until the instantaneous sum of forces $F_4$ and $F_1$ becomes equal to or just below the sum of the forces $F_3$ and $F_2$ at the time that the valve opened. The pressure difference represented in these values, as between the opening and closing conditions, represents the pressure that causes the pulsating action to occur.

It may be observed that the threaded relationship of plug 44 constitutes a means for selectively adjusting the strength of compressive force urged by spring 38 and, thereby, constitutes a control of force $F_3$. In this manner, pulsation frequency may be controlled with respect to a given applied water pressure. As specifically embodied in FIG. 1, diaphragm 56 serves primarily only as a fluid seal between chamber 22 and the interior of extension 36. However, the resiliency in such a seal also may serve as part of the overall force mechanism and, indeed, may even completely substitute for the function of spring 38 as exemplified hereinafter in connection with the alternative embodiment of FIGS. 13–16.

In the embodiment of FIGS. 5–8, a housing 60 of generally cylindrical form defines a chamber 62 within which is disposed a piston assembly 64 having a first piston 66 of smaller area and a second piston 68 of comparatively larger area. Pistons 66 and 68 are spaced apart by a shaft 70 slideably reveived within the internal bore of a washer 72 having a series of openings 73 that complete fluid communication through cavity 62 and between the opposing faces of the two different pistons. An inlet 74 admits water or other fluid into chamber 62, and an outlet 76 leads outwardly therefrom. In this case, outlet 76 is formed centrally through a plug 78 threadably received into the bore of housing 60 so as to permit adjustability of the valve seat presented by the internal face of plug 78 to piston 66. Coupled to plug 78 by a nipple 80 is a sprayhead 82 provided with a series of openings 84 arranged so as to permit the emission of a spray of water from outlet 76. Threaded within the opposite end of housing 60 is a plug 86 which captivates a spring 88 against the side of piston 68 remote from piston 66. An air vent 89 is located in the wall of housing 60 between plug 86 and piston 68. A shaft 90, including a threaded coupling 92, extends from piston 66 effectively to an external knob 94. The external protrusion of shaft 90 and the provision of knob 94 permits adjustment of the amount by which coupling 92 is threaded onto the innermost shaft portion 95. That adjustment enables selective variation of a limited amount of free movement of piston 66 relative to shaft 70, and that free movement effects a delay in action. Adjustment of the delay affords control of pulse rate. Piston 66 is in the form of a flexible cup 96 mounted on shaft 90 by means of opposing washers and facing the valving face of plug 78. Flexing of the wall of piston 66 effects another period of delay in the action.

Operation of the embodiment of FIGS. 5–8 follows the principles discussed with regard to FIG. 1 by use of FIGS. 2–4. Thus, fluid from an external source enters through inlet 74. That entering fluid tends to force piston 68 rearwardly of the outlet and in compression of spring 88. Initially, flexible cup 96 is sealed against plug 78. That seal still remains intact during the initial movement of piston assembly 64 until the displacement is sufficient that cup 96 is pulled away from plug 78 so as to break the sealing relationship therebetween. When that sealing relationship is broken, the fluid theretofore stored within chamber 62 exits through outlet 76, the fluid being forced in that direction by a corresponding forward movement of piston assembly 64. The outletting of fluid ceases when cup 96 again forms a seal against plug 78. At that point, piston assembly 64 again begins its rearward motion so as to initiate another cycle of operation.

Figure 12:
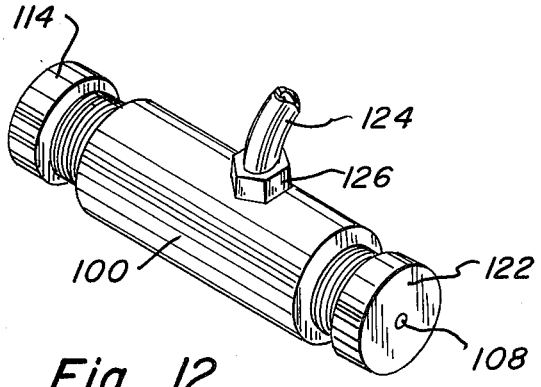
FIG. 12 is a perspective view of the pulsator shown in FIGS. 9–11.
Figure 14:
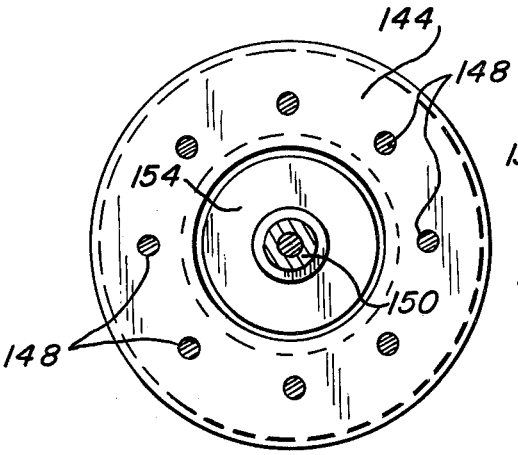
FIG. 14 is a cross-sectional view taken along the line 14—14 in FIG. 13.
Figure 13:
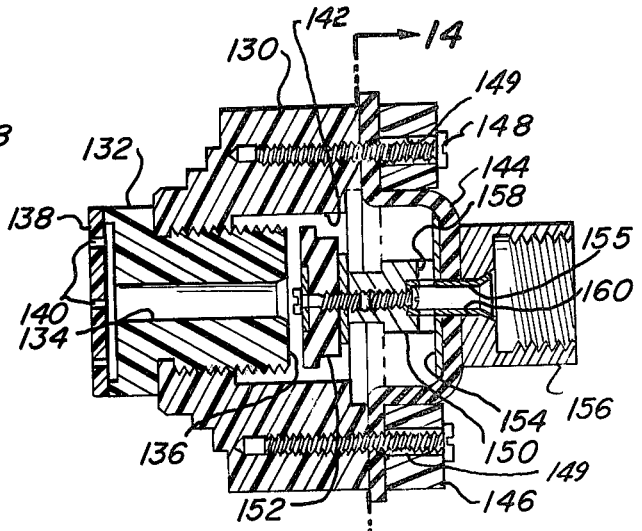
FIG. 13 is a centrally-taken cross-sectional view of a still different form of pulsator.
Figure 15:
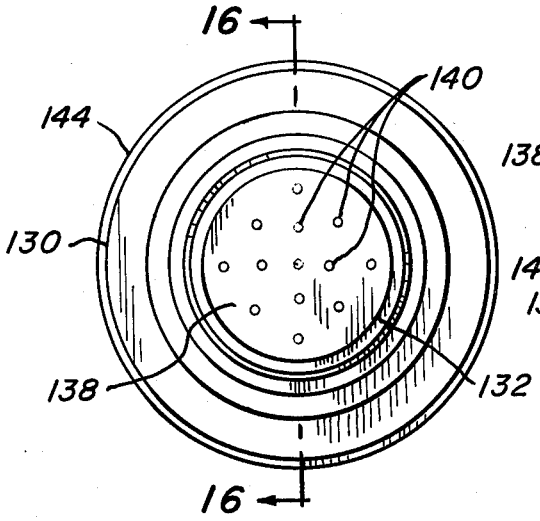
FIG. 15 is an end-elevational view taken from the left side of the apparatus of FIG. 13.
Figure 16:
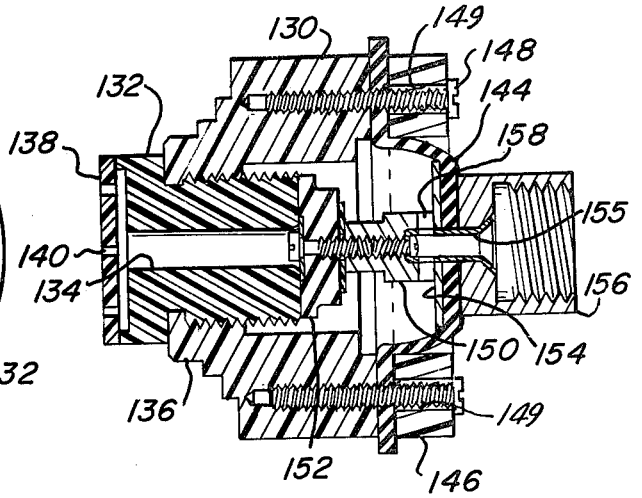
FIG. 16 is a cross-sectional view taken along the line 16—16 in FIG. 15 and showing certain internal parts in a different position from that shown in FIG. 13.

A somewhat simplified version is shown in FIGS. 9–12. In this case, a housing 100 defines a cavity 102 in which is received a piston assembly 104 that includes a smaller piston 106 facing an outlet opening 108 and a comparatively larger piston 110 at the other end of chamber 102. A coil spring 112 is compressed between piston 110 and a plug 114 threadably received within the rearward end of housing 100. Plug 114 includes an air vent 116 communicating with the interior of housing 100 that encloses spring 112. An inlet 118 communicates from the exterior to chamber 102. Piston 106 once again includes a flexible cup 120 that mates with the internal face of a plug 122 that centrally defines outlet 108 and is treadably received within the interior of that end portion of housing 100. As shown in FIG. 12, a water inlet hose 124 is connected into inlet 118 by a fitting 126. Operation is the same as described with respect to the version of FIGS. 5–8.

A more compact alternative is the subject of FIGS. 13–16. In this case, a cylindrical housing 130 threadably receives at one end an outlet plug 132 that includes an axial outlet opening 134. The inner face 136 of plug 132 defines a valve seat, while the outer end portion of plug 132 is closed by a cup 138 that includes a plurality of apertures 140, communicating with outlet 134, for the purpose of emitting a spray discharge. Housing 130 defines an internal chamber 142 that is completed by the internal wall of a flexible diaphragm 144 clamped around its margin to that end of housing 130 by a collar 146. Collar 146 is secured in place by means of a circumferentially-spaced plurality of screws 148 that extend through corresponding openings 149 into housing 130.

Disposed within chamber 142 is a piston assembly 150 at one end of which affixed by a threadable fastener is a piston 152 of resilient material and of a size to mate with the valve seat defined by the internal face of plug 132. At the other end of assembly 150 is a washer 154 disposed against one side of a central portion of diaphragm 144 and secured thereagainst by a fastener extending through the bottom of a bushing 155 in a coupling 156 located on the opposite side of diaphragm 144 from washer 154. Coupling 156 is internally threaded so as to accept a fluid input adapter. Ports 158 in piston assembly 150 communicate through bushing 155 into coupling 156 so as to constitute an inlet of fluid into chamber 142.

It will thus be observed that the combination of coupling 156 and ports 158 constitutes an entry for the water axially of housing 130. Also, the central portion of diaphragm 144, as defined by washer 154 and coupling 156, serves as the second and larger piston with respect to piston 152. Therefore, diaphragm 144 serves the multiple function of defining part of the internal cavity, constituting part of the larger piston and also serving as the silent means which establishes force $F_3$ in terms of the discussion directed to FIGS. 2–4.

In all of the different embodiments, a pulsating action of a piston assembly is relied upon for the production of a pulsating output of a fluid such as water in response to a supply of that water under more or less constant pressure. The defined parameters are such that the flow pressure when the valves are open may be quite close to the static pressure existing when the valve mechanism is closed. This feature tends to minimize the development of water hammer in supply lines. In practical implementation, all but the resilient element may conveniently be formed of plastic. Moreover, and although the drawings have depicted various threadable relationships between different parts for maximum of flexibility of adjustment, it is entirely possible to fabricate the different components assemblies with essential integration of the different parts so as to minimize ultimate cost of materials and assembly.

The embodiments work well with water, and water has been mentioned above at various places in the explanation. However, the embodiments also function properly with a number of other fluids, including different liquids and various gases of which air is an example.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. A fluid-flow pulsator comprising:

a housing defining an internal chamber and having means defining an inlet and an outlet each communicating with said chamber, said inlet admitting said fluid under a predetermined substantially constant static pressure thereof and said outlet releasing said fluid from said chamber;

means for supplying said fluid under said predetermined substantially constant static pressure;

a piston assembly mounted for movement within said housing, said assembly including a first piston spaced a fixed distance during operation from a second piston effectively toward said outlet and with said first piston having a first area, exposed within said chamber to pressure of fluid introduced therein through said inlet, less than a corresponding second area of said second piston;

means associated with said assembly for valvingly closing said outlet when said assembly is moved theretoward;

means for resiliently urging said assembly in a direction effecting closure of said outlet with said first and second pistons effectively being disposed in said chamber on opposite sides of said inlet;

said pressure within said chamber, the strength of said urging means and said areas being correlated to produce and are essentially determinative of the production of pulses of fluid from said outlet in response to a supply of fluid to said inlet, said pressure acting on said second area creating a first force tending to move said assembly in a direction to effect opening of said outlet, said pressure acting on said first area creating a second force tending to move said assembly in a direction to effect closure of said opening, the strength of said urging means acting on said second piston creating a third force tending to move said assembly in a direction to effect closure of said opening, and a fourth force tending to move said assembly in a direction to effect opening of said outlet with said fourth force equaling the sum of said second and third forces during closure of said opening but being created by said pressure acting on said first area during opening of said outlet;

and said pressure, said strength and said areas being selected so that said assembly moves in the opening direction when said first force exceeds the sum of said second and third forces and moves in the closing direction when the sum of said first and fourth forces falls below the sum of said second and third forces existing upon opening of said outlet.

2. A pulsator as defined in claim 1 which includes means for selectively adjusting the strength of said urging means.

3. A pulsator as defined in claim 1 in which said chamber includes a nose portion, of reduced size compared with the remainder of said housing, that cooperates with said first piston to define a valve seat for said associated means.

4. A pulsator as defined in claim 3 in which said outlet is defined in said nose portion outwardly beyond said valve seat.

5. A pulsator as defined in claim 1 in which said piston assembly includes means for resiliently mounting said assembly from said housing for said movement therein.

6. A pulsator as defined in claim 5 in which said urging means also is located within said housing and in which said mounting means fluid-seals said chamber from said urging means.

7. A pulsator as defined in claim 1 which includes means defining said inlet as an opening through said housing and disposed in a position between said first and second pistons.

8. A pulsator as defined in claim 1 which includes means defining said outlet as an opening through said housing and disposed in a position beyond said first piston from said second piston.

9. A pulsator as defined in claim 1 in which said chamber is tubular and which further includes means extending axially of said housing for guiding movement of said piston assembly within said chamber.

10. A pulsator as defined in claim 1 in which said closing means includes a valve member engageable with a valve seat and in which one of said member and said seat is resilient in the direction of said movement.

11. A pulsator as defined in claim 10 in which said valve member forms a part of said first piston, and in which said valve member exhibits resilient sealing action when moved in the direction of said movement.

12. A pulsator as defined in claim 11 in which said associated means includes means for adjusting the degree of said sealing action.

13. A pulsator as defined in claim 1 in which said housing includes a cavity receptive of said urging means and said second piston, and which further includes means for venting said cavity upon movement of said second piston.

14. A pulsator as defined in claim 1 in which said housing is generally tubular and in which said inlet is defined for entrance of said fluid axially of said housing.

15. A pulsator as defined in claim 14 wherein said urging means forms a part of said second piston.

16. A pulsator as defined in claim 1 in which said urging means forms a part of said second piston.

17. A pulsator as defined in claim 1 in which said urging means defines a portion of the wall of said chamber.

18. A pulsator as defined in claim 1 in which said urging means defines a portion of said second piston.

19. A pulsator as defined in claim 1 which further includes means for effecting a delay in pulsation action during each cycle of pulsation.

20. A pulsator as defined in claim 19 in which said delay means includes flexible walls which form a part of said first piston.

21. A pulsator as defined in claim 19 in which said delay means includes a coupling that enables a limited amount of free movment of said first piston relative to said second piston.

22. A pulsator as defined in claim 19 which also includes means for enabling a selective variation in the amount of said delay.

* * * * *